US006076995A

United States Patent [19]

Tauchi et al.

[11] Patent Number: 6,076,995

[45] Date of Patent: Jun. 20, 2000

[54] SEGMENTS

[75] Inventors: Eiji Tauchi; Akihiko Nakano; Kenta Matsubara; Hiroki Someya; Susumu Okayama, all of Tokyo, Japan

[73] Assignees: Obayashi Corporation, Osaka; Ishikawajima Construction Materials Co., Ltd., Tokyo, both of Japan

[21] Appl. No.: 09/239,788

[22] Filed: Jan. 29, 1999

[30] Foreign Application Priority Data

Aug. 11, 1998 [JP] Japan ..... 10-227412

[51] Int. Cl.[7] ..... E21D 11/00

[52] U.S. Cl. ..... 405/153; 405/151; 405/150.1; 405/135

[58] Field of Search ..... 405/132, 133, 405/134, 135, 146, 150.1, 151, 152, 153; 403/353; 411/544, 149, 150

[56] References Cited

U.S. PATENT DOCUMENTS

| | | | |
|---|---|---|---|
| 4,477,204 | 10/1984 | Rohde et al. | 405/151 |
| 4,515,501 | 5/1985 | Thomas | 405/151 |
| 4,830,536 | 5/1989 | Birch et al. | 405/153 |
| 5,035,538 | 7/1991 | Mitchell | 405/153 |
| 5,537,794 | 7/1996 | Tolliver et al. | 405/153 |
| 5,634,312 | 6/1997 | Tolliver et al. | 405/153 |

FOREIGN PATENT DOCUMENTS

| | | | |
|---|---|---|---|
| 0 317 220 | 5/1989 | European Pat. Off. . | |
| 0 386 368 | 9/1990 | European Pat. Off. . | |
| 2 737 535 | 2/1997 | France . | |
| 2-030898 | 2/1990 | Japan . | |
| 30898 | 2/1990 | Japan | 405/153 |
| 9-221994 | 8/1997 | Japan . | |
| 10-115190 | 5/1998 | Japan . | |
| 10-140988 | 5/1998 | Japan . | |
| 10-176494 | 6/1998 | Japan . | |
| 10-205289 | 8/1998 | Japan . | |
| 2 103 684 | 2/1983 | United Kingdom . | |

*Primary Examiner*—Eileen Dunn Lillis
*Assistant Examiner*—Frederick L. Lagman
*Attorney, Agent, or Firm*—Finnegan, Henderson, Farabow, Garrett & Dunner, L.L.P.

[57] ABSTRACT

One end of a circumferential joining end surface 2 of segments 1 which are joined together in the circumferential direction of an excavated tunnel is made the male side circumferential joining end surface 2*a* on which a male coupler 4 is provided, and the other end is made a female side circumferential joining end surface 2*b* on which a female coupler 5 is provided. On a base plate 7, a bolt 10, which provides an engagement part 16 comprising a flat washer 13, a disc spring 14, and a head 15, is erected, and made a male coupler 4. An engagement plate 23, formed by a notch 22 which engages the bolt 10, and is inserted and engaged between the base plate 7 and the engagement part 16, and tightly held by the elastic force of the disc springs 14, is made the female coupler 5. One of the axial joining end surfaces of the segments 1 joined together in the axial direction of the excavated tunnel is provided with an axial male coupler 31 having a joining rod 35, and the other end is provided with an axial female coupler 41 which holds in and fastens the joining rod 35. In this manner, the joining operation between segments 1 can be simplified, and the operational efficiency improved.

16 Claims, 14 Drawing Sheets

SEGMENTS

FIELD OF THE INVENTION

The present invention relates to segments which form a tubular wall in the axial direction of an excavated tunnel by linking a plurality of segments together.

BACKGROUND OF THE INVENTION

As a method for constructing a tunnel, what is termed the sealed construction, wherein a tubular wall is constructed by assembling segments (mainly made of concrete or steel) on the inner surface of an excavated tunnel is well known.

As segments used in this sealed construction, a rectangular arc shaped plate in planar view is the most common type, and each of these segments are joined together with bolts.

In the most common structure for joining the segments together with bolts, when abutting the joining surfaces of the segments with each other, coupler plates having holes communicating with each other are buried in the neighborhood of the joint surface of the segments, bolts are inserted into the holes of the coupler plates, the bolts are fastened with nuts, and the segments are joined. In addition, there are also structures wherein an metal insertion fittings are buried in the segments, and both are joined together by fastening the bolt member which runs through the adjacent segments.

However, in the above-described structures, at the construction site, the complicated operations of inserting the bolts into the holes formed on the joining surface of the coupler and fastening the bolts to the nuts, and fastening the bolts to the metal insertion fitting buried in each of the segments are necessary, and thus there are limits to reducing the assembly time. In addition, this is difficult to apply automatic assembly by robots. Furthermore, even if the secondary covering construction is omitted, because bolts and nuts are installed, it is necessary to carry out the closing operation of the bolt boxes formed on the segments. In aiming to speed up the operation and make it more energy efficient, in the present state, the development of a new coupler structure is a pressing need.

Therefore, it is an object of the present invention to provide segments which can be joined together very easily and securely.

SUMMARY OF THE INVENTION

The segment of the present has provided a male coupler on one joining end surface and a female coupler on the other joining end surface among the joining end surfaces in the circumferential direction of the arc shaped segment which forms the tubular wall in the excavated tunnel by joining them together in the circumferential and axial directions of the excavated tunnel; the male coupler has a base plate, a rod having a large diameter part at the end and erected on this base plate, a flat washer provided on the base plate side of this large diameter part of this rod, and an elastic member provided between this large diameter part and the flat washer; the female coupler has an engagement plate formed with an notch that this rod can engage from the side, and by the rod engaging by sliding into this notch, it is inserted between the washer and the base plate, and tightly held by the elastic force of the elastic member.

Therefore, by inserting the rods provided on the one of the male couplers on the joining end surface into the notches which engage the engaging plate of the female coupler of the other joining end surface, the large diameter part of the rods can very easily be engaged in the inner surface of the engaging plate, and by this engaging force, can join in the circumferential direction of the excavated tunnel.

In this manner, compared to a fastening structure using bolts and nuts, or a joining structure which joins a bolt to a metal insertion fitting, it is possible to greatly reduce the labor power necessary for the operation of joining segments to each other, and at the same time, it is possible simplify the automatic assembly by robots. Furthermore, because there are no bolt boxes, the operation of closing the bolt boxes can be omitted.

Further, because the engagement plate between the base plate and the flat washer is inserted using the urging force of the elastic member, even when there is a slight error in the dimensions, this error can be tolerated, and in addition, it is possible to absorb vibrations due to earthquakes, etc., at the joining points, and it is possible to build a tubular wall of superior durability.

DETAILED DESCRIPTION OF THE PREFERRED EMBODIMENTS OF THE INVENTION

Below, the segments of the present invention will be explained referring to the figures.

Figure 1:
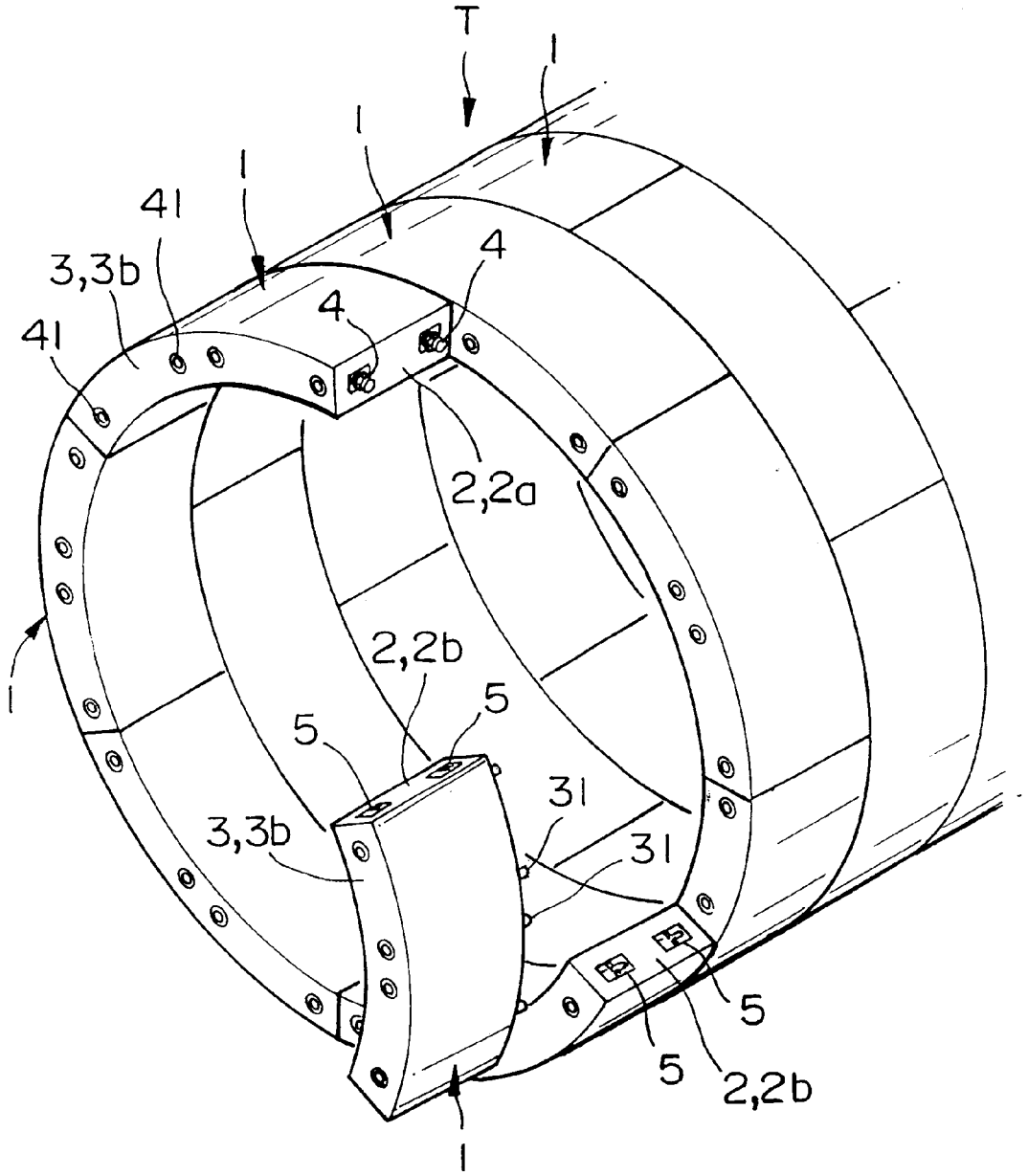
FIG. 1 is a perspective view of the tubular wall constructed from the segments for explaining the composition and structure of the segments of the present invention.
Figure 2:
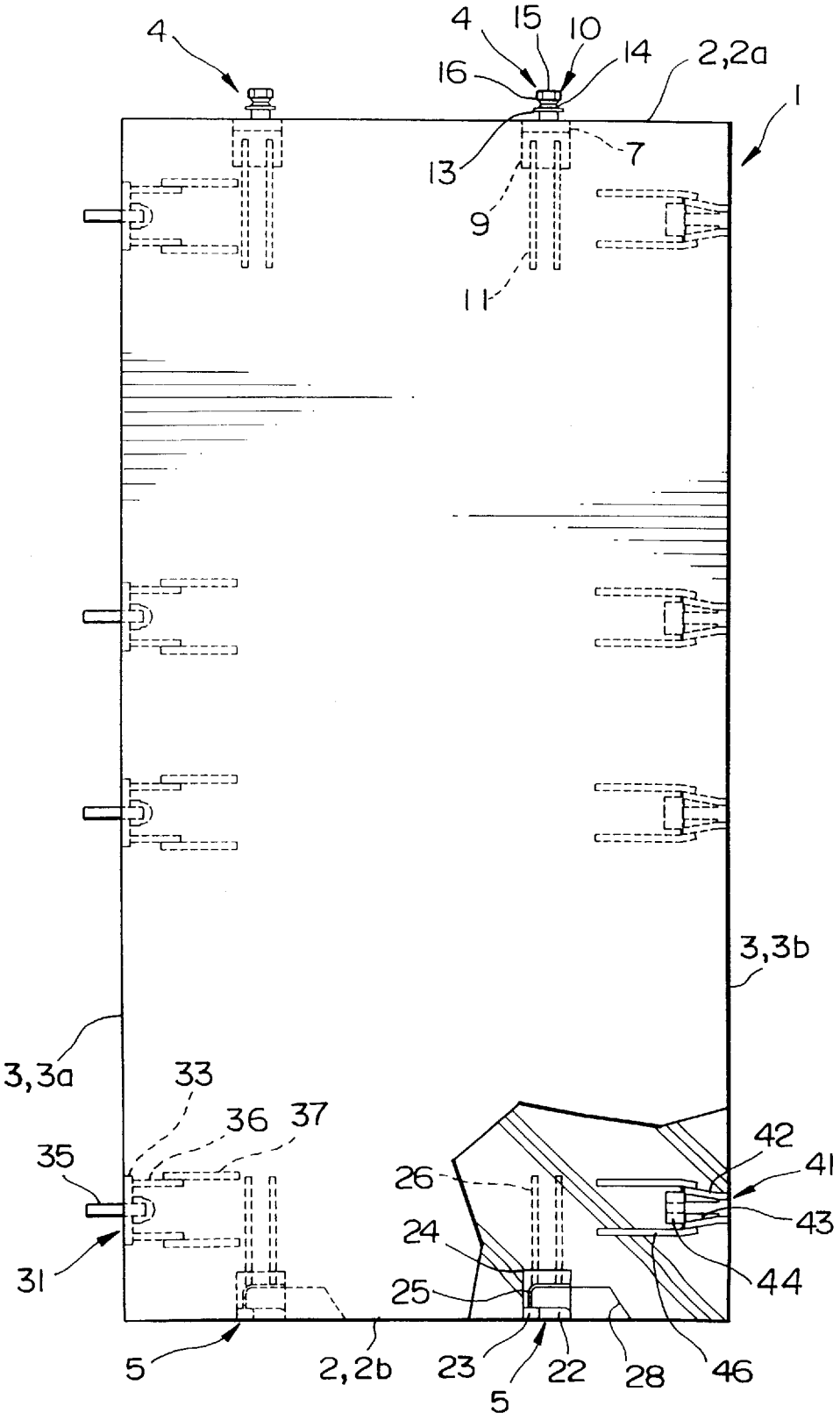
FIG. 2 is a planar view of the tubular wall constructed from the segments for explaining the composition and structure of the segments of the present invention.

In FIG. 1 and FIG. 2, reference numeral 1 is a segment. This segment 1 is made of concrete formed in a rectangle in planar view. By joining together the circumferential joining end surfaces 2, which are the joining end surfaces in the circumferential direction of the excavated tunnel, and joining together the axial joining end surfaces 3, which are the joining end surfaces in the axial direction of the excavated tunnel, of this segment 1, the tubular wall T comprising these segments 1 is constructed inside the excavated tunnel.

Next, the joining structure of the circumferential joining end surface 2 and the axial joining end surface 3 for these segments will be explained. (Joining structure in the circumferential direction of the excavated tunnel)

Figure 3:
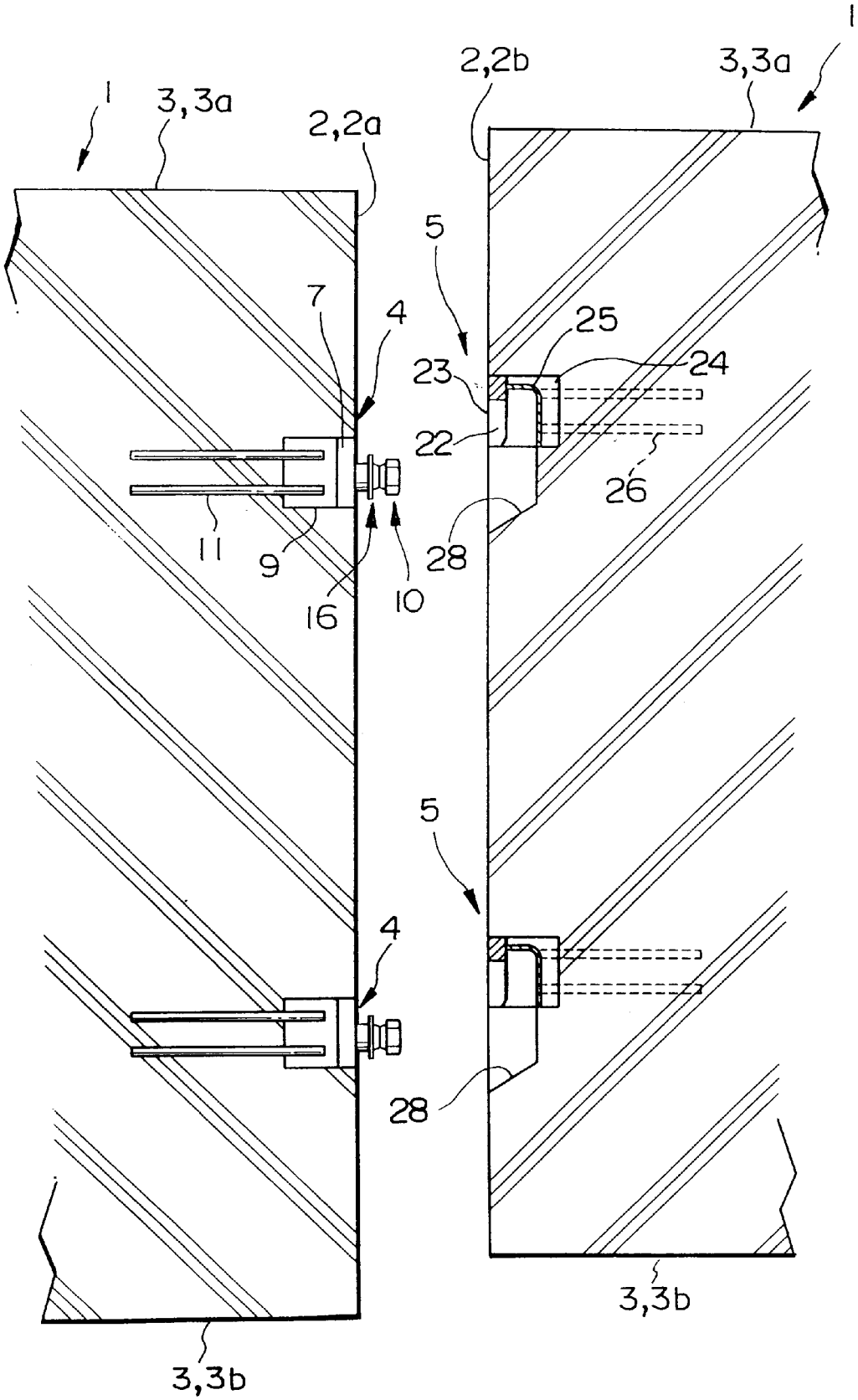
FIG. 3 is a cross-sectional view of the joint of the joined segments to explain the joining structure in the circumferential direction of the excavated tunnel of the segments of the present invention.

In this segment 1, as shown in FIG. 3, one end of the circumferential joining end surface 2 is a male side circumferential joining end surface (one of the circumferential joining end surfaces) 2*a*, and the other is the female side circumferential joining end surface (the other of the circumferential joining end surfaces) 2*b*.

Figure 4:
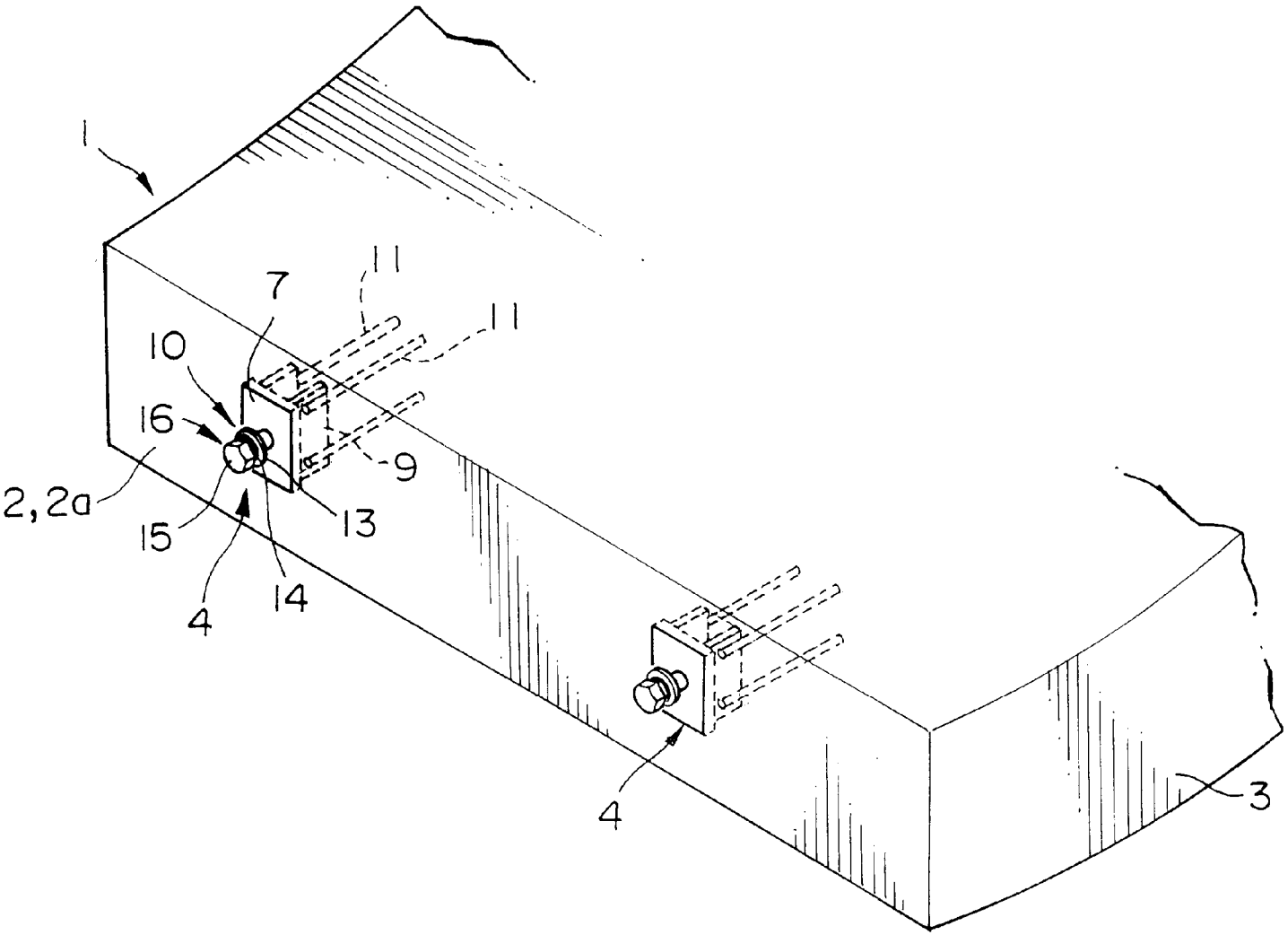
FIG. 4 is a perspective view of the segments showing the male joining end surface in the circumferential direction of the segments of the present invention.
Figure 5:
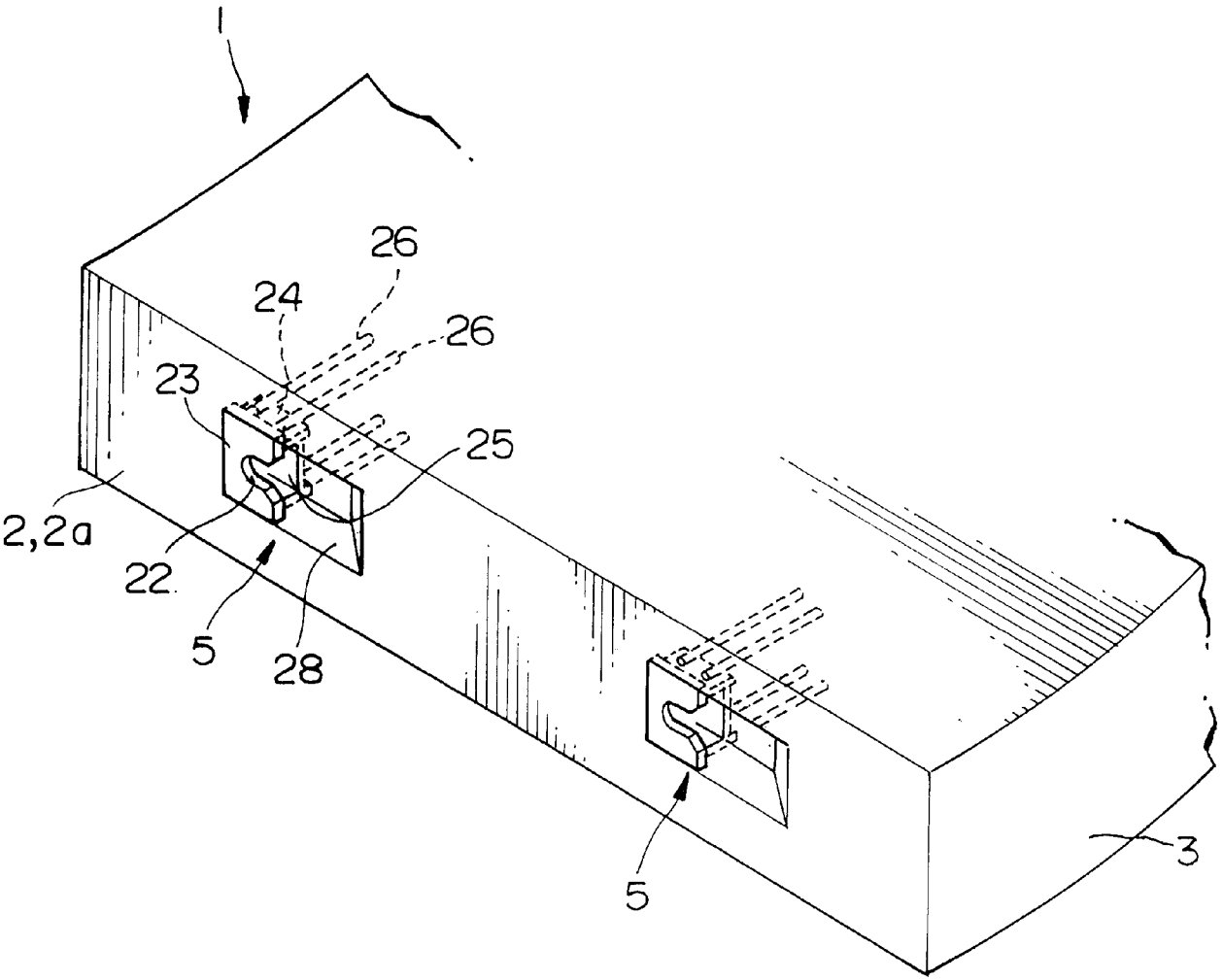
FIG. 5 is a perspective view of the segments showing the female joining end surface in the circumferential direction of the segments of the present invention.

On the male side circumferential joining end surface 2*a*, as shown in FIG. 4, a plurality of male couplers 4 are provided, and on the female side circumferential joining surface 2*b*, as shown in FIG. 5, a number of female couplers 4 identical to that of the male couplers 5 is provided.

Figure 6:
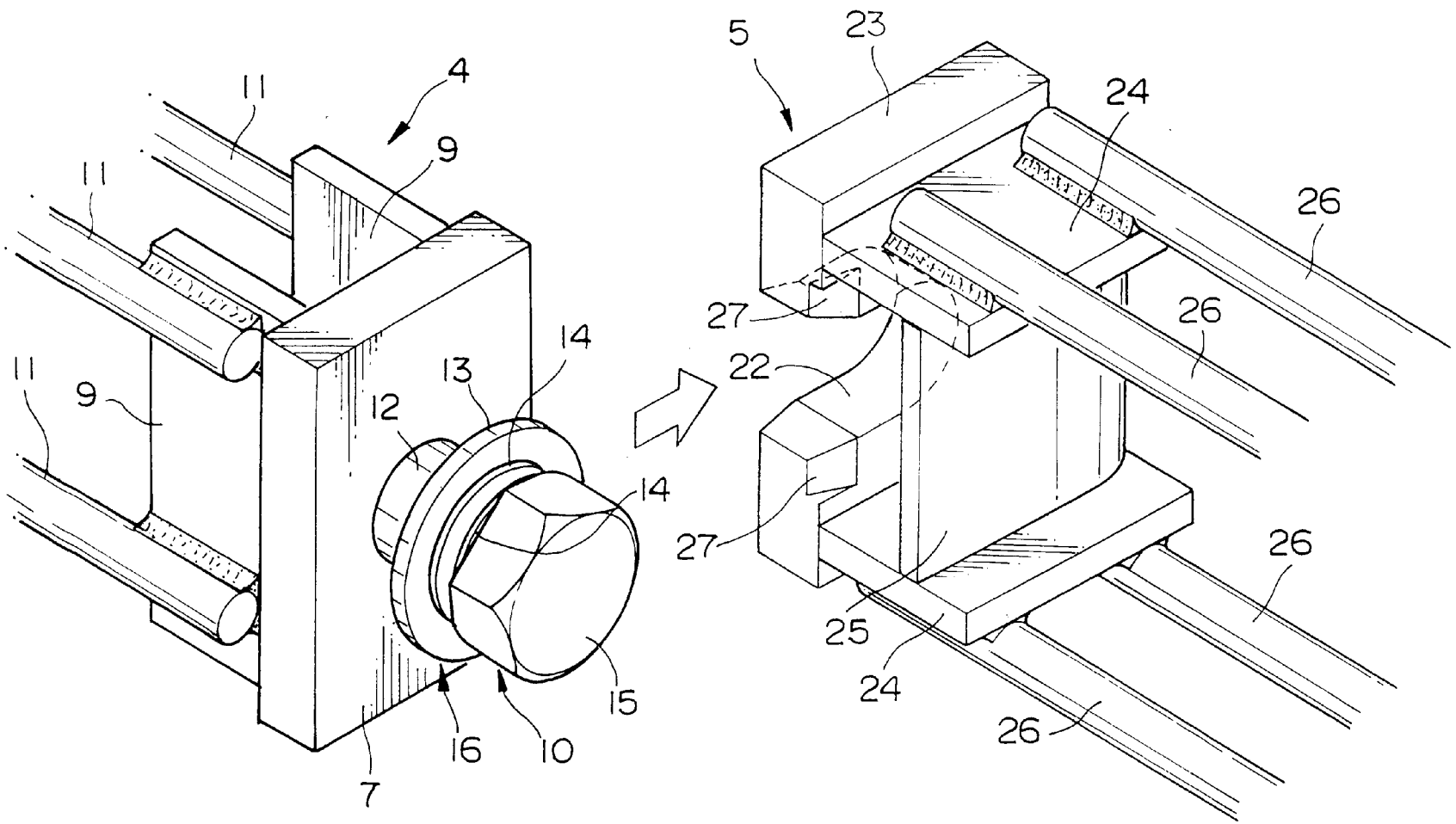
FIG. 6 is a perspective view of the female coupler and the male coupler of the segments of the present invention.
Figure 7:
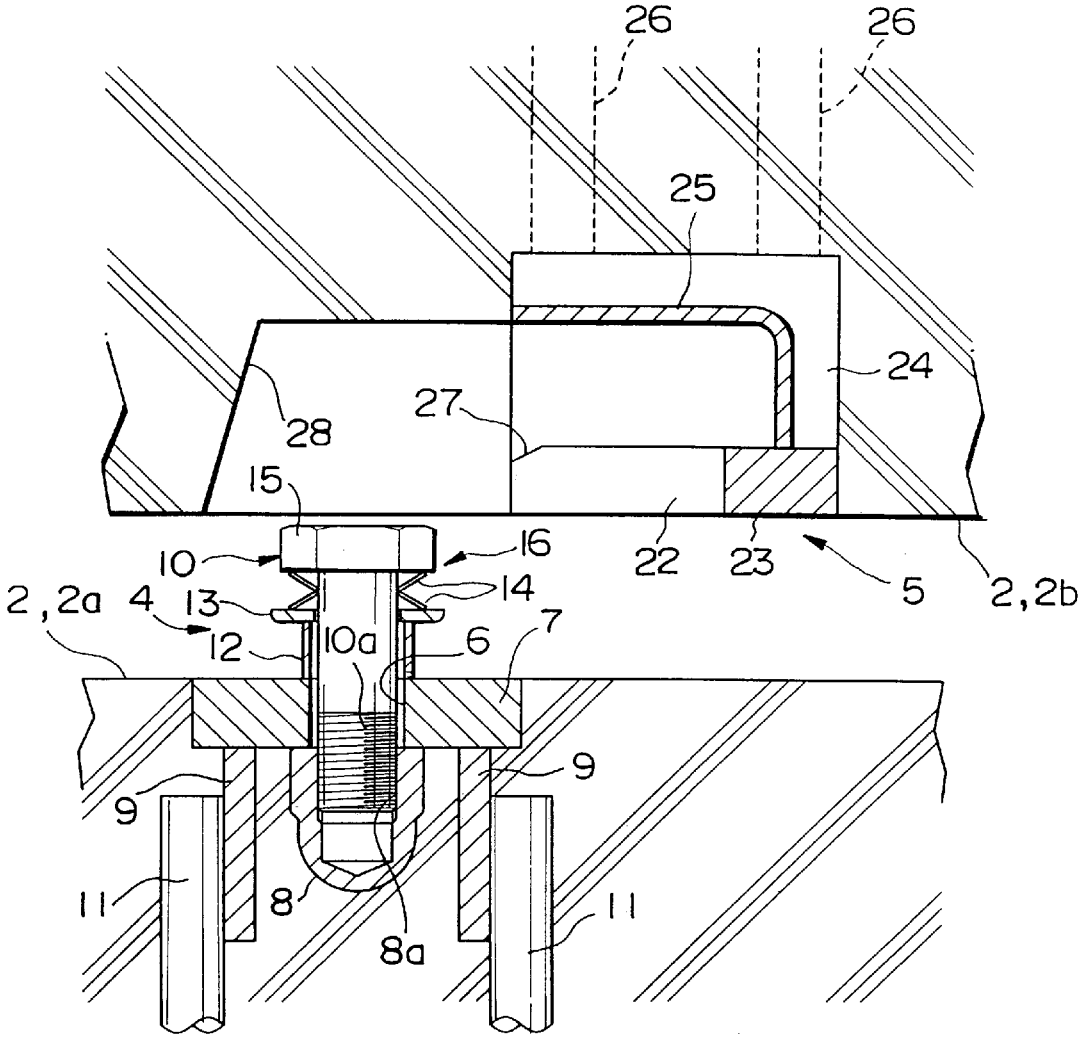
FIG. 7. is a cross-sectional view of a joint for explaining the structure of the male coupler and the female coupler of the segments of the present invention.

The male coupler 4, as shown in FIG. 6 and FIG. 7, has a base plate with the hole 6 formed therein roughly in the center, a cap nut 8 anchored at the communication position with this hole 6 on the inner side of this base plate 7, a pair of side plates 9 which are anchored on the inner side of this base plate 7, and a bolt (rod) 10 anchored in a condition protruding from the base plate 7 by connecting a screw 10*a* inserted on to the hole 6 from the outer side of the base plate 7 to a screw 8*a* of the cap nut 8. On the side plate 9 an anchor 11, which anchors the male coupler 4 to the segment 1, is provided.

The bolt 10, in order from the base plate 7, is provided with a spacer 12 having cylindrical form, a flat washer 13, and a plurality of disc springs (elastic members) 14. The engaging part 16 which engages the engaging plate 23 of the male coupler 5 described below is formed from the flat washer 13, the disc spring 14, and the head of the bolt (the large diameter part) 15.

In addition, a gap between the flat washer 13 of the engagement part 16 of the above structure and the outer surface of the base plate 7 is maintained at a specified dimension by a spacer 12.

The flat washer 13 which forms the engaging part 16 is rounded on the outer edge on the base plate 7 side. That is, this flat washer 13 is installed with the bored side in the direction of the base plate 7 when the boring process is carried out.

The plurality of disc springs 14 provided between the flat washer 13 and the head 15 is disposed such that their tapered directions are in the opposite direction. Here, the outer edges of the respective disc springs 14 are disposed such that they are separated from each other in the axial direction.

The female coupler 5 has an engagement plate 23 formed by the notch 22. On the inner side of this engagement plate 23, a pair of side plates 24 are anchored, and between these side plates 24, a base plate 25 having an L shape in cross-section is provided.

On the side plate 24, an anchor 26 which anchors this female coupler 5 to the segment 1 is provided. The notch 22 of the engagement plate 23 of the female coupler 5 is shaped with a taper that widens gradually towards to end. In addition, on the inner side of the engagement plate 23 in the area of the end of the notch 22, a taper surface 27 is at a diagonal such that the thickness gradually increases from the end.

In addition, the dimension of the thickness of the engaging plate 23 at the end of this taper surface 27 is smaller than the dimension between the flat washer 13 of the engagement part 16 of this male coupler 4 and the outer surface of the base plate 7.

On the female circumferential joining surface 2*b* providing the female coupler 5, a concave part 28 on the notch 22 side of the engagement plate 23 is formed.

When joining the male coupler 4 and the female coupler 5 in the above described structure, the bolt 10 of the male coupler 4 is located in the concave part 26 formed on the side of the female coupler 5, the male circumferential joining end surface 2*a* and the female circumferential joining end surface 2*b* of the segments 1 are abutted against each other, and engaged with the bolt 10 of the notch 22 of the engaging plate 23 by sliding.

In this manner, the flat washer 13 of the engagement part 16 abuts the tapered surface 27 of the engaging plate 23, and is inserted into the inner side of the engagement plate 23 by being guided in the inclined direction of the tapered surface 27.

When the flat washer 13 of the engagement part 16 is inserted into the inner surface of the engagement plate 23, the flat washer 13 pushes in the direction of the head 15 of the bolt 10, and the flat spring 14 disposed between the flat washer 13 and the head 15 is pushed in by pressure.

Figure 8:
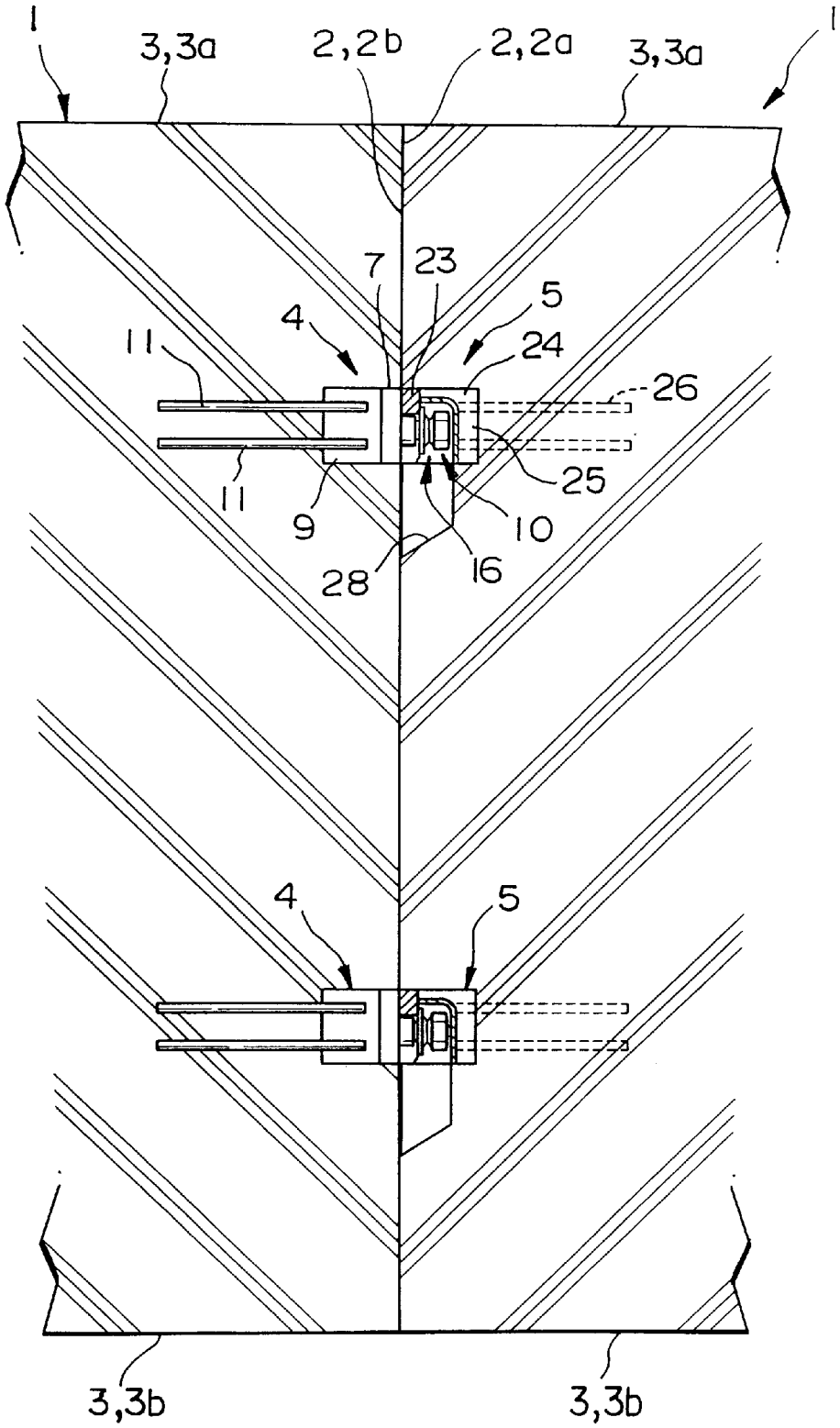
FIG. 8 is a cross-sectional view of the joints of the segments joined together for explaining the joining structure in the circumferential direction of the excavated tunnel of the segments of the present invention.
Figure 9:
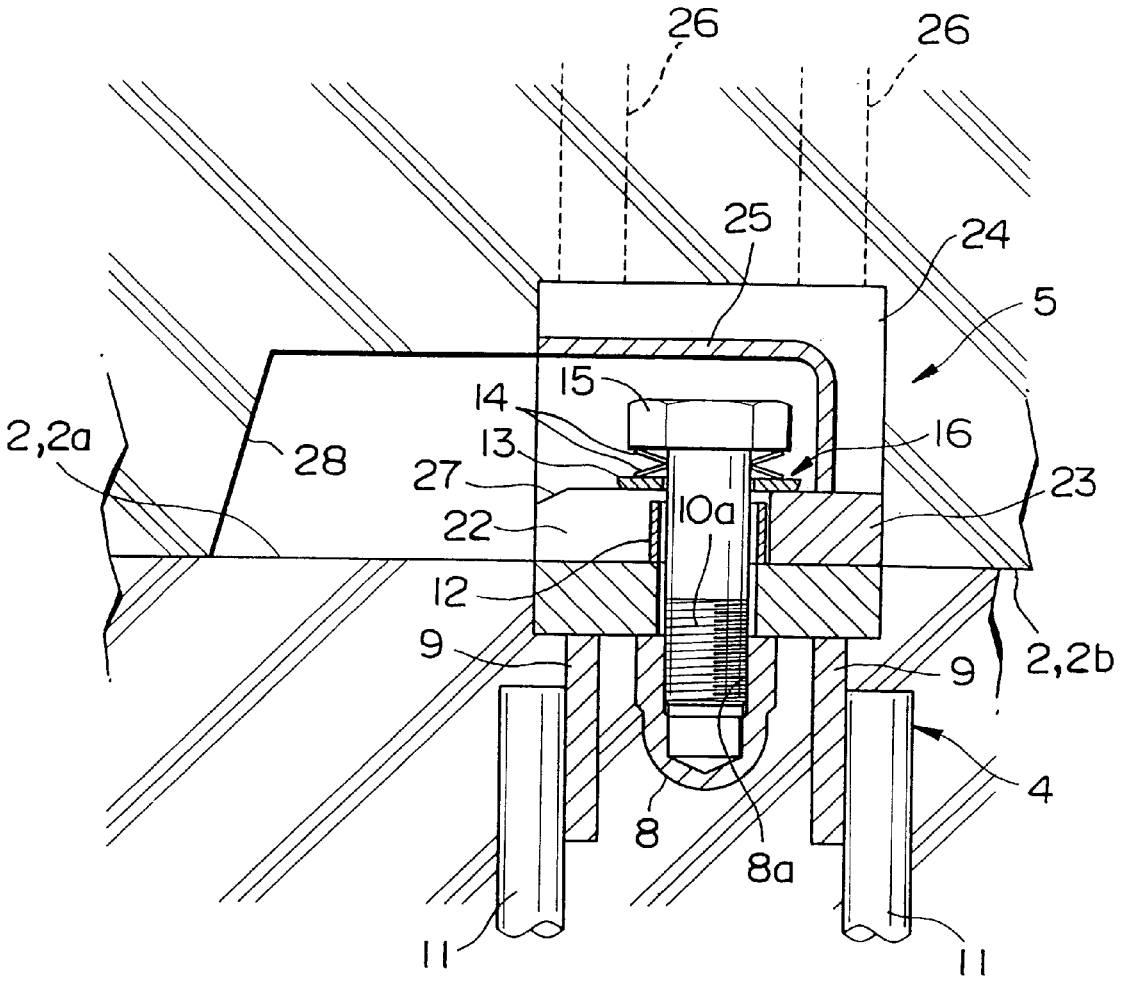
FIG. 9 is a cross-sectional view of the joints for explaining the joining structure in the circumferential direction of the excavated tunnel of the segments of the present invention.

In addition, along with this bole 10, the male coupler 4 is drawn up to the female coupler 5 side, and the male side circumferential joining end surface 2*a* and the female side circumferential end surface 2*b*, as shown in FIG. 8 and FIG. 9, are engaged so that each of their joining end surfaces 2*a*, 2*b* are firmly in contact due to pressure.

Figure 10:
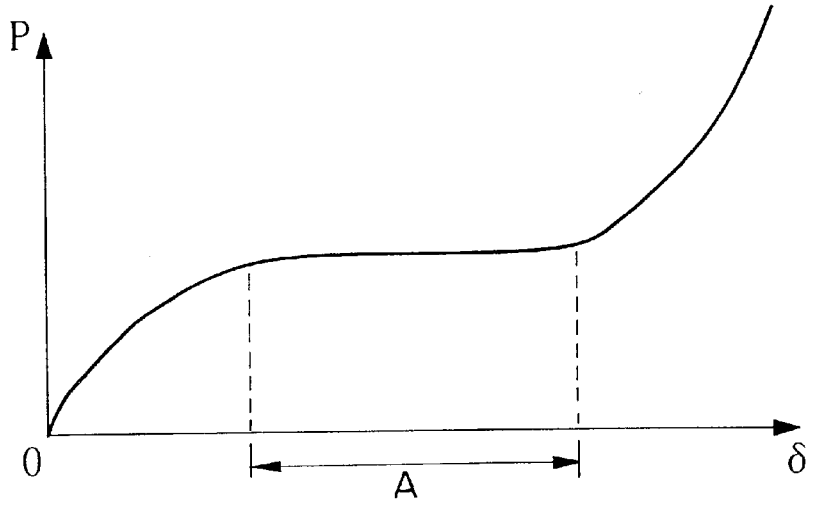
FIG. 10 shows the relationship between the elasticity and bending of the disc spring provided on the male coupler of the segments of the present invention.
Figure 11:
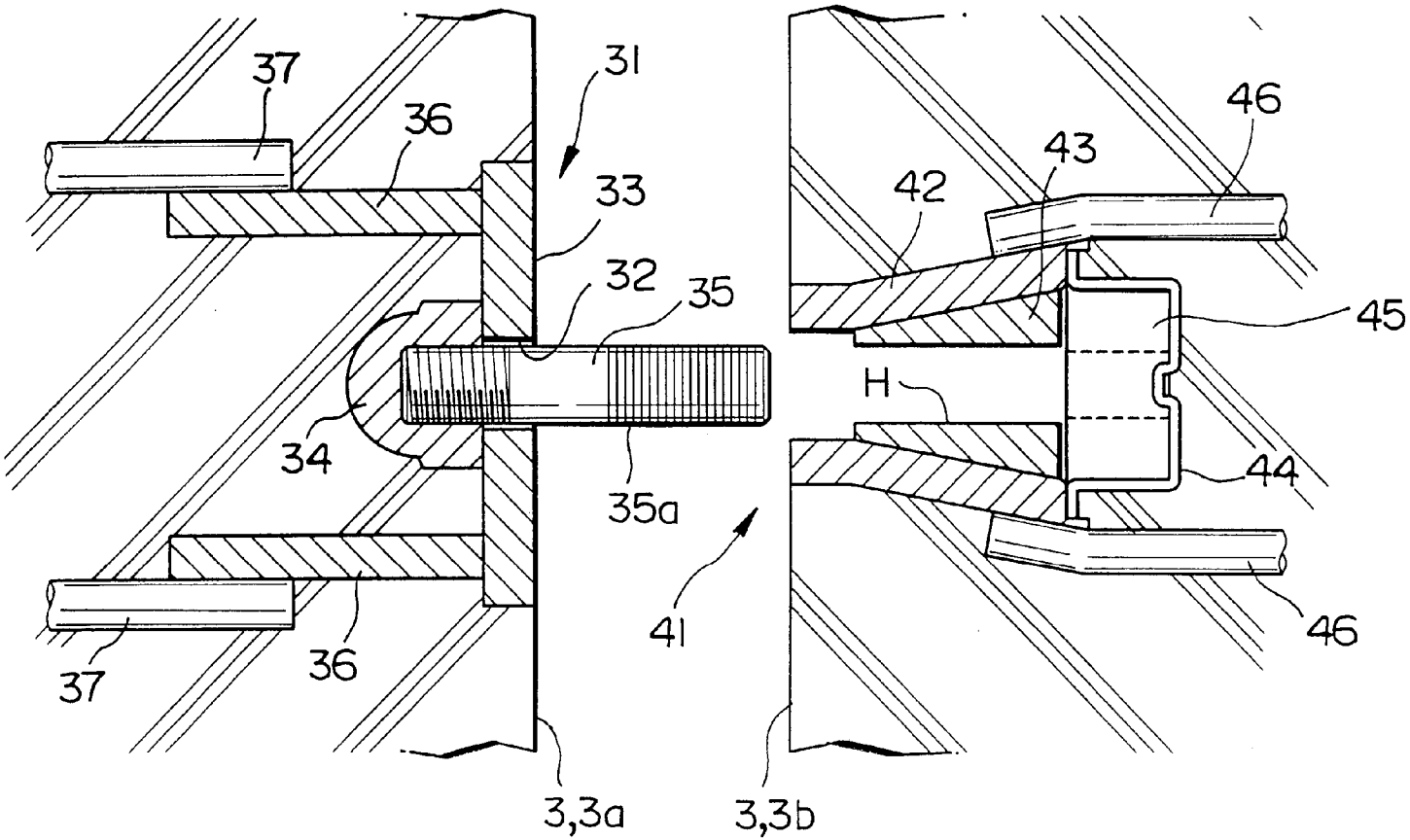
FIG. 11 is a cross-sectional view of the joint of the segment for explaining the joining structure in the axial direction of the excavated tunnel for the segments of the present invention.

Here, the flat spring 14 of the engagement part 16 of the male coupler 4 has the characteristics shown in FIG. 10.

That is, as shown in this figure, for the flat spring 14, there is an area in which the change in the elastic force P is small compared to the change in the amount of deformation δ. In the coupler structure described above, when engaging the engagement plate 23 of the female coupler 5 between the engagement part 16 of the male coupler 4 and the base plate 7, the dimension of the protrusion length of the bolt 10 and the dimension of the thickness of the engagement plate 23 are set so that the state of the flat spring 14 is defined by area A. (Joining structure in the axial direction of the excavated tunnel)

Additionally, in segment 1, one of the axial joining end surfaces 3 has a male side axial joining end surface (one of the axial joining end surfaces) 3*a*, and the other has a female side axial joining end surface (the other of the axial joining end surfaces) 3*b*.

On the male side axial joining end surface 3*a*, a plurality of axial male couplers 31 is provided, and on the female side axial joining end surface 3*b*, a plurality of axial female couplers 41 is provided.

An axial male coupler 31 has a coupling plate 33 with a hole 32 formed therein, and a joining rod 35 which is inserted into the hole 32 of this coupling plate 33, and is anchored by being screwed into a cap nut 34 anchored at a position facing this hole 32 on the inner surface side of the coupling plate 33. This joining rod 35 has a serrated part 35*a* having a concavo-convex form in the circumferential direction at its end.

In addition, on the coupling plate 33 of this axial male coupler 31, a side plate 36 is a nchored by anchor 37, and integrated with the concrete forming the segment 1.

The axial female coupler 41 has a sleeve 42 and a plurality of wedges 43 provided within this sleeve 42.

The sleeve 42 has a tapered form, and the wedges 43 provided therein are disposed in a circle to form an insertion anchoring hole H into which the joining rod 35 is inserted in the center, and by the outer circumferential surface making contact with the inner circumferential surface of the sleeve 42, and are placed so as to be freely movable in the lengthwise direction of the sleeve 42. That is, the sleeve 42 has a tapered form which gradually widens radially in the direction of the insertion of the joining rod 35.

A spring case 44 is provided on the distal end of the sleeve 42, which forms a large diameter. Inside this spring case 44, a urethane spring 45 is enclosed as an urging member which urges the wedges 43 towards the smaller diameter proximal end of the sleeve 42 such that the insertion anchor hole H is reduced in diameter.

In this axial female coupler 41 as well, an anchor 46 anchored to the sleeve 42 is provided. The axial female coupler 41 is integrated with the cement forming the segment 1 by this anchor 46.

In addition, when the joining rod 35 of the axial male coupler 31 is inserted into the sleeve 42 of the axial female coupler 41 having the above described structure, the wedge 43 compresses the urethane spring 45, and is retracted from the bottom of the sleeve 42, the insertion anchoring hole H formed by the wedges 43 is widened, and the joining rod 35 is inserted into this insertion anchoring hole H.

Here, because the wedges 43 are always urged in the direction of compressing the insertion anchoring hole H by pressing on the proximal end of the sleeve 42 due to the urging force of the urethane spring 45, the joining rod 35 inserted into the insertion anchoring hole H is caught and anchored securely by the wedges 43. Furthermore, on the joining rod 35, because of the serrated part 35*a* formed on the proximal end, this joining rod 35 and the wedges 43 are fastened with a large fastening force.

In addition, the wedges 43 in the axial female coupler 41 compress further in response to a withdrawing movement of the joining rod 35, and because this anchoring force increases, the joining rod 35 is strongly joined to the axial female coupler 41.

Next, the assembly of the tubular wall T by joining of segments 1 having the above described construction will be explained.

When assembling the tubular wall T by joining together the segments 1 having the above described structure, first, the female side circumferential joining end surface 2*b* of the segment 1 to be newly installed is abutted against the male side circumferential joining end surface 2*a* of the previously installed segment 1 which makes up the tubular wall T in the circumferential direction of the excavated tunnel. At this time, the bolt 10 of the male coupler 4 provided on the male side circumferential joining end surface 2*b* is abutted in a condition shifted from the axial direction of the excavated tunnel so as to be brought into the concave part 28 formed in the female side circumferential joining end surface 2*b*. Then, from this condition, the newly joined segment 1 is made to slide.

Carrying out these steps, the bolt 10 forming the male coupler 4 is engaged with the notch 22 of the engagement plate 23 which forms the female coupler 5, and the flat washer 13 which forms the engagement part 16 of the bolt 10 is abutted against the tapered surface 27 of the engagement plate 23. Further, the flat washer 13 enters the inside surface of the engagement plate 23 by being guided in the direction of the inclination of the tapered surface 27, and the flat washer 13 is pushed up in the direction of the head 15 of the bolt 10. In this manner, the disc spring 14 disposed between the flat washer 13 and the head 15 is deformed by compression.

Additionally, along with this bolt 10, the male coupler 4 is drawn towards the female coupler 5 side, and the male side circumferential joining end surface 2*a* and the female side circumferential joining end surface 2*b* are joined in a condition of a strong mutual pressure connection by the elastic force of the disc spring 14.

Furthermore, as described above, in order to join the circumferential joining end surfaces 2 with each other, when the segment 1 is made to slide, the joining rod 35 of the axial male coupler 31 provided on the male side axial joining end surface 3*a* of this segment is inserted in the sleeve 42 of the axial female coupler 41 provided on the female side axial joining end surface 3*b* of the already installed segment 1. In this manner, the wedges 43 retract the bottom side of the sleeve 42 by compressing the urethane spring 45, the insertion anchoring hole H formed by the wedges 43 is widened, and the joining rod 35 is inserted into this insertion anchoring hole H. In addition, the insertion anchoring hole H, which is pushed by the proximal end of the sleeve 42 by the urging force of the urethane spring 45, hooks and anchors the joining rod 35 by the wedges 43 which are always urged in the direction of compression, and the female side axial joining end surface 3*b* and the male side axial joining end surface 3a are securely joined.

As explained above, using the above described segment 1, by the bolt 10 provided on the male coupler 4 of the male side circumferential joining end surface 2*b* being inserted into the notch 22 formed on the engagement plate 23 of the female coupler 5 of the female side circumferential joining end surface 2*b* in the circumferential direction of the excavated tunnel, the engagement part 16 of the bolt 10 can be easily engaged on the inside surface of the engagement plate 23. In addition, by the joining rod 35 of the axial male coupler 31 of the male axial joining end surface 3*a* being inserted into the sleeve 42 of the axial female coupler 41 provided on the female side axial joining end surface 3*b* in the axial direction of the excavated tunnel, the joining rod 35 of the axial male coupler 31 can be hooked extremely easily by the wedges 43 provided in the sleeve 42 of the axial female coupler 41, and due to the fastening force, can be securely joined in the axial direction of the excavated tunnel.

In this manner, in comparison with the conventional fastening structure using bolts and nuts or the joining structure wherein bolts are fastened to insertion fittings, the labor required for the joining operation between the segments 1 can be greatly reduced, and in addition, it is possible to implement simplification of automatic assembly by robot. In addition, because there are no bolt boxes, it is possible to omit the closing operation of the bolt boxes.

In addition, because the inner surface in the region of the notch 22 of the engagement plate 23 of the female coupler 5 is a tapered surface 27, and the engagement part 16 of the bolt 10 of the male coupler 4 is disposed by being guided to the inner side of the engagement plate 23 by the tapered surface 27, by engaging the engagement parts 16 of the bolts 10 of the male couplers 4 into the notch 22 of the engagement plate 23 of the female coupler 5, the female coupler 5 and the male coupler 4 hook on each other, and the female side circumferential joining end surface 2*b* and the male side circumferential joining end surface 2*a* can be very strongly joined.

Furthermore, because the engagement part 16 which forms the male coupler 4 has an elastic member consisting of a plurality of disc springs 14 piled up together, even if there is a small error in dimensions, this error can be tolerated. In addition, it is possible to absorb vibrations from earthquakes, etc., at the joints, and a superior earthquake resistant tubular wall can be constructed.

In addition, because the points of contact between the flat washer 13 which forms the engagement part 16 of the male coupler 4 and the engagement plate 23 are a curved arc surface, at the time of joining, the contact resistance between the engagement part 16 and the engagement plate 23 can be greatly reduced. In this manner, the engagement part 16 can be very smoothly guided to the engagement position on the inner surface of the engagement plate 23.

Figure 12:
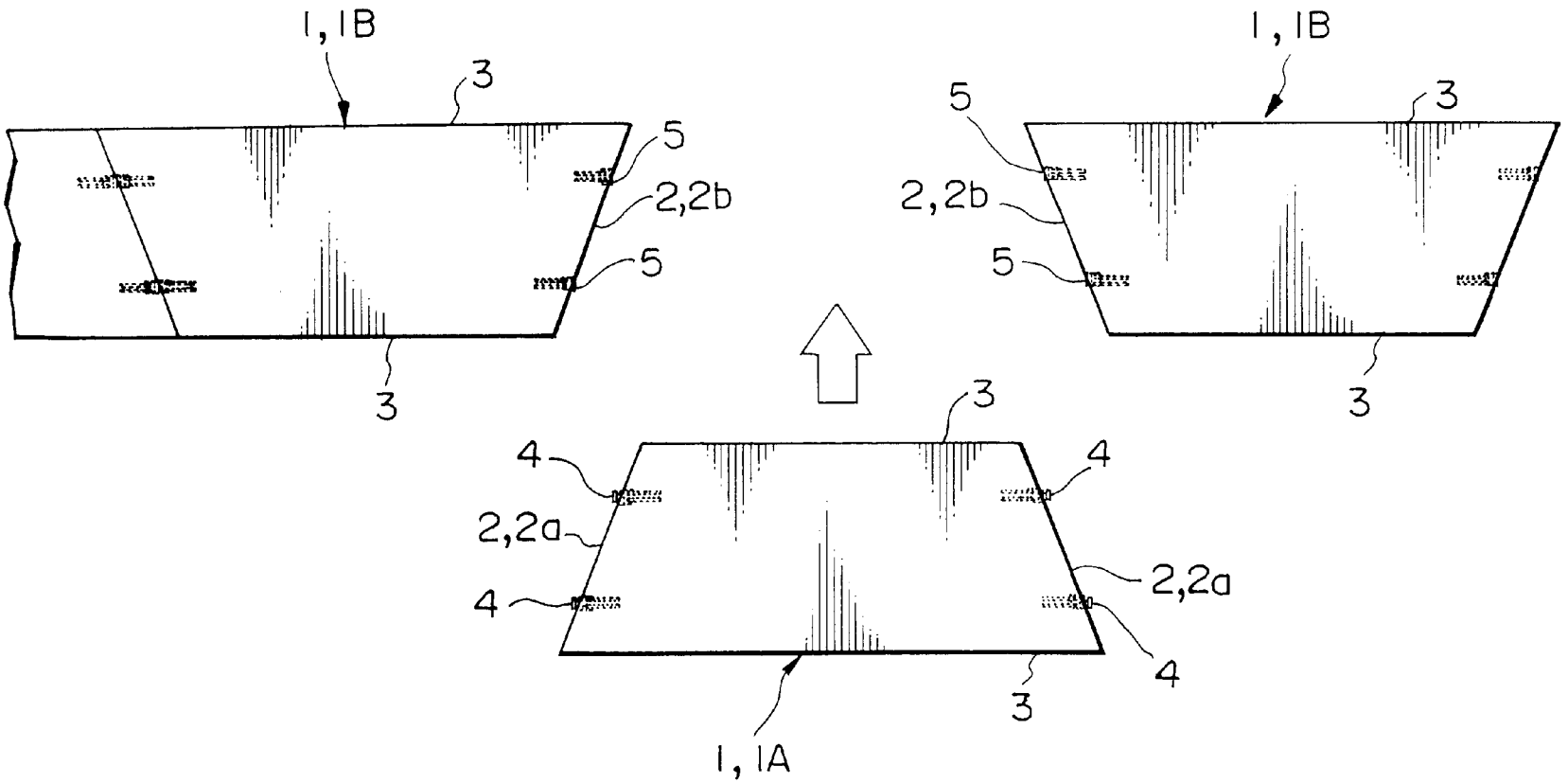
FIG. 12 is a planar view of the segments joined together for explaining the composition and structure of the other segments of the present invention.

In addition, segment 1 is not limited to a rectangle in planar view in FIG. 12, as described above, but could also formed having a trapezoid shape in planar view.

Here, a segment formed in this trapezoid shape in planar view will be explained.

Segment 1 formed in a trapezoid shape in planar view comprises an arc plate in which the respective joining end surfaces 2 in the circumferential direction of the excavated tunnel incline towards the axial direction of the excavated tunnel, and by being respectively joined circumferentially, the ring forming the tubular wall T is constructed.

These segments 1 have a male type segment 1A in which both joining end surfaces 2 are male side circumferential joining end surfaces 2*a* and a female type segment 1B in which both joining end surfaces 2 are female side circumferential joining end surfaces 2*b*. The male type segment 1A and the female type segment 1B are connected to each other in the circumferential direction.

Figure 13:
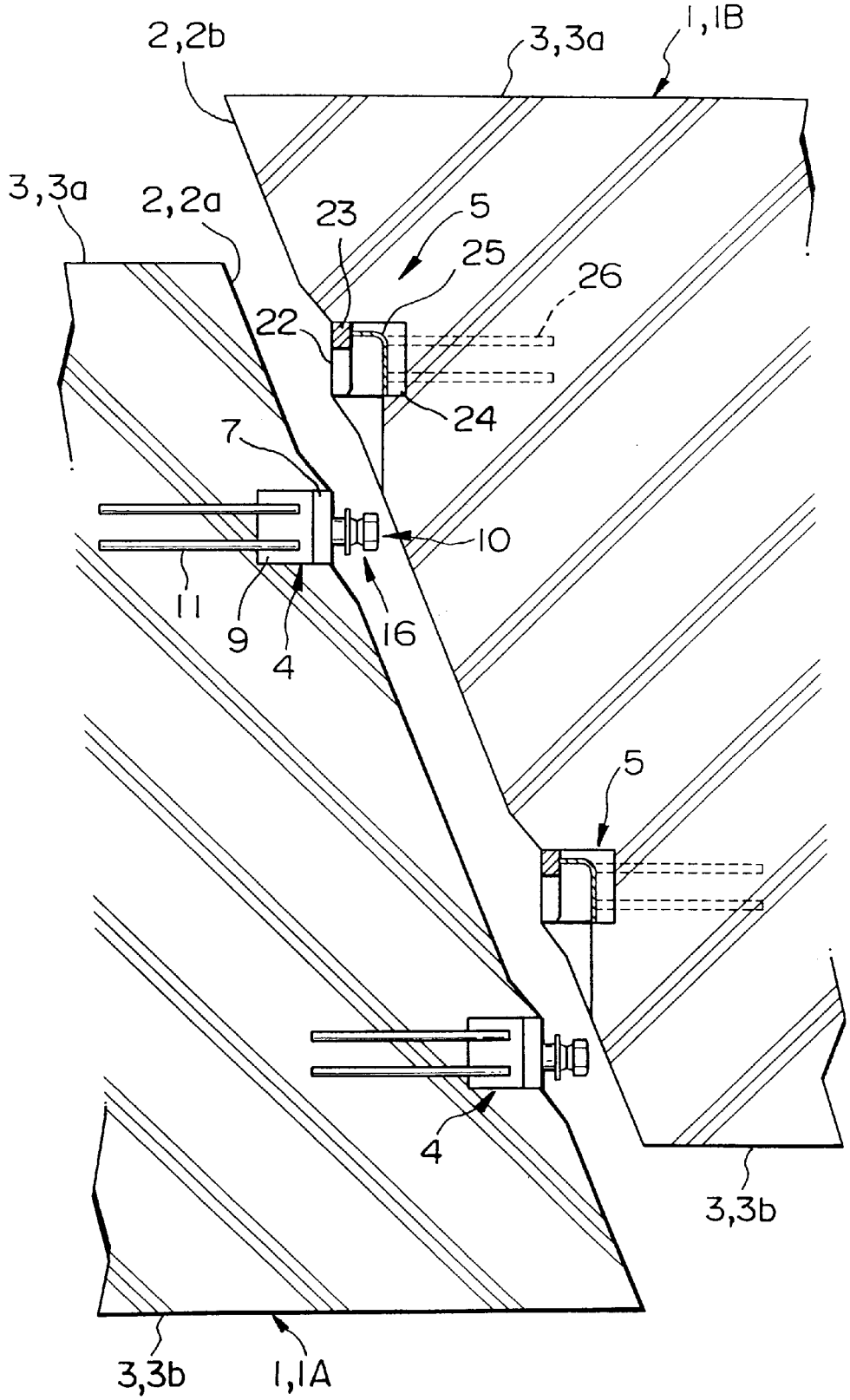
FIG. 13 is a cross-sectional view of the joints of the segments for explaining the composition and structure of the other segments of the present invention.

As shown in FIG. 13, on the male type segment 1A, a male coupler 4 having the above described structure is provided on the male side circumferential end surface 2*a*. On the female type segment 1B, a female coupler 5 having the above described structure is provided wherein the male coupler 4 is joined to on the female side circumferential joining end surface 2*b*.

Figure 14:
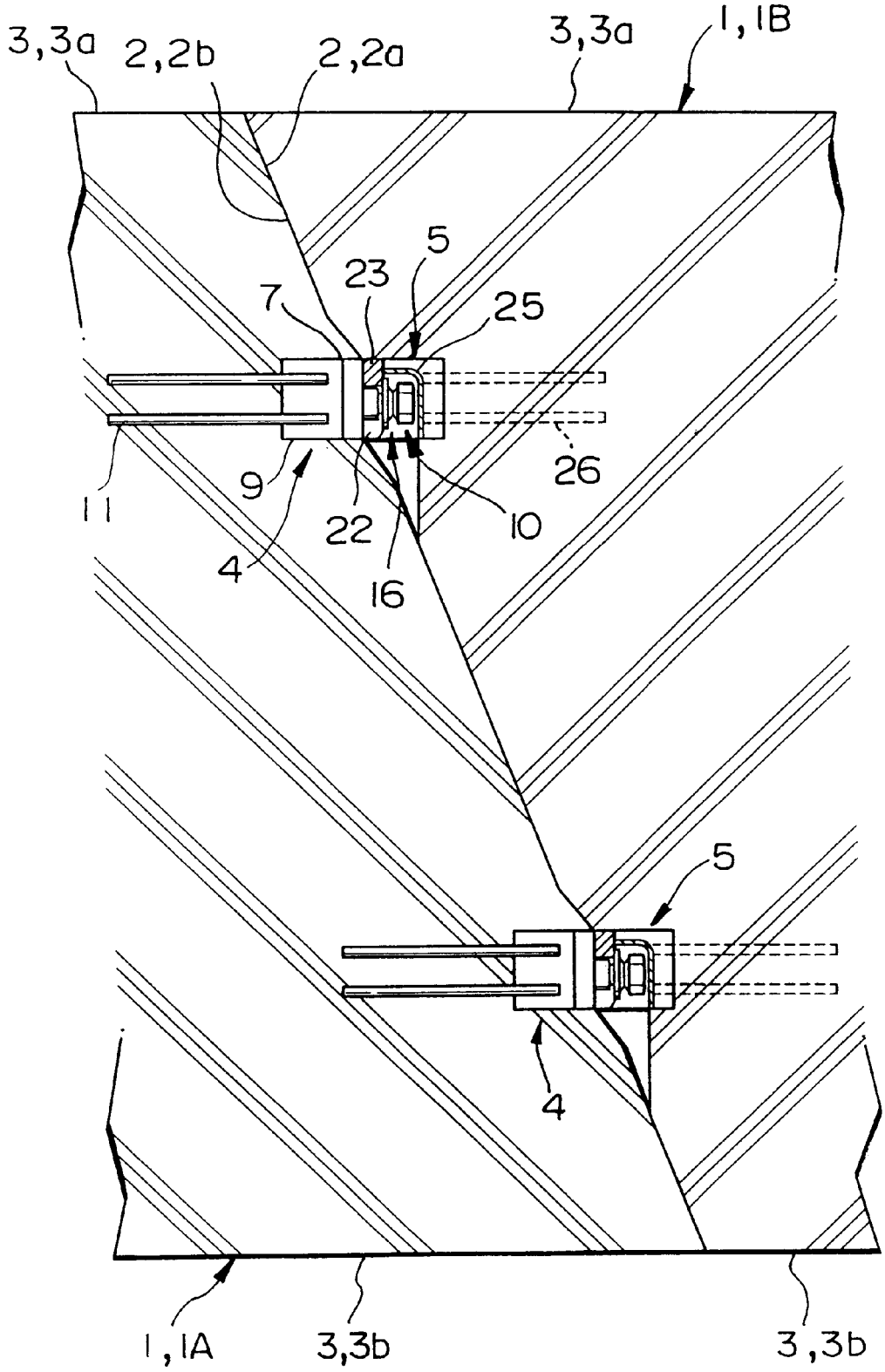
FIG. 14 is a cross-sectional view of the joints of the segments for explaining the composition and structure of the other segments of the present invention.

In the case of the segments 1A and 1B having a trapezoidal shape in planar view are joined, the male type segments 1A are fit into the female type segments 1B. In this manner, the bolt 10 of the male coupler 4 provided on the joining end surface 2*a* of the male type segment 1A can be inserted into the notch 22 formed on the engagement plate 23 of the female coupler 5 of the female type segment 1B, and as shown in FIG. 14, the engagement part 16 of the bolt 10 is engaged to the inner surface of the engagement plate 23, and by this engagement force, the male type segment 1A and the female type segment 1B are joined.

Moreover, of course the segments 1 are not limited to a concrete construction, but can also be made of steel.

In addition, in the above described example, an L-shaped bottom plate 25 is provided on the female coupler 5, and a space is formed into which the head 15 of the bolt 10 of the male coupler 4 can enter, but this bottom plate 25 can be omitted, and an intermediate, for example, can be installed on the mold which forms a space into which the head 15 can be inserted.

What is claimed is:

1. A segment wherein:

a male coupler is provided on one joining end surface and a female coupler is provided on the other end of a joining end surface among the joining end surfaces in the circumferential direction of an arc shaped segment which forms a tubular wall inside an excavated tunnel by being joined together in the circumferential and axial directions of the excavated tunnel;

said male coupler has a base plate, a rod having a large diameter proximal end and erected on said base plate, a flat washer provided on the base plate side of said large diameter part of this rod, and an elastic member provided between said large diameter part and the flat washer; and a female coupler has an engagement plate on which a notch allowing engagement from the side of said rod is formed, and by engaging the rod by sliding into this notch, said rod is inserted between said washer and said base plate, and grasped by the elastic force of said elastic member.

2. A segment according to claim 1 wherein said elastic member comprises a plurality of overlaid tapered disc springs.

3. A segment according to claim 2 wherein said disc springs are located so as to be in the opposite direction as the direction of the taper.

4. A segment according to claim 1 wherein said engagement plate has a tapered surface formed which guides said flat washer to the inner surface of said engagement plate at the joints with said disc washers.

5. A segment according to claim 1 wherein said flat washer has contact points with said engagement plate taking the form of a curved arc surface, and the contact resistance with said engagement plate is reduced.

6. A segment according to claim 1 wherein said rod comprises a bolt, and the head of this bolt is said large diameter part.

7. A segment according to claim 6 wherein a nut is provided on said base plate into which said bolt is screwed.

8. A segment according to claim 1 wherein a concavity into which the rod of the male coupler engaged in the notch of the engagement plate can be disposed being formed in the side of said female coupler.

9. A segment according to claim 1 wherein the joining end surface in the circumferential direction of the excavated tunnel inclines towards the axial direction of the excavated cave.

10. A segment according to claim 1 formed from concrete.

11. A segment according to claim 10 wherein an anchor rod buried in the concrete is provided on said male coupler and said female coupler.

12. A segment according to claim 1 formed by assembling steel plates.

13. A segment according to claim 1 wherein:

an axial male coupler is provided on one joining end surface and an axial female coupler is provided on the other end of a joining end surface in the joining end surfaces joined together in the axial direction of the excavated tunnel;

said axial male coupler has a joining rod protruding from one end of the axial joining surface; and said axial female coupler has a tapered sleeve with said joining rod inserted therein, and which widens gradually in the forward direction of insertion, a plurality of wedges which are circularly positioned forming the insertion anchoring hole of said joining rod in the center of said sleeve, and are disposed to be freely movable in the lengthwise direction of said sleeve by their outer peripheral surface touching the inner circumferential surface of said sleeve, and an urging member which urges said wedges in the rearward insertion direction of said joining rod.

14. A segment according to claim 13 formed from concrete.

15. A segment according to claim 14 wherein an anchor rod buried in the concrete is provided on said male coupler and said female coupler.

16. A segment according to claim 13 formed by assembling steel plates.

* * * * *